United States Patent [19]

Smith, Jr.

[11] Patent Number: 4,943,064

[45] Date of Patent: Jul. 24, 1990

[54] DUNK TANK SEAT RELEASE MECHANISM

[76] Inventor: Harry C. Smith, Jr., 520 Thompson Ave., Lehigh Acres, Fla. 33936

[21] Appl. No.: 398,764

[22] Filed: Aug. 24, 1989

[51] Int. Cl.[5] ..... A63B 63/00; A63F 9/02

[52] U.S. Cl. ..... 273/384

[58] Field of Search ..... 273/384

[56] References Cited

U.S. PATENT DOCUMENTS

| | | | |
|---|---|---|---|
| 1,021,019 | 3/1912 | Van Kannel | 273/384 |
| 2,202,738 | 5/1940 | Keller | 273/384 |
| 3,262,704 | 7/1966 | Abraham et al. | 273/384 X |
| 3,306,143 | 2/1967 | Ortman | 81/368 |
| 4,466,616 | 8/1984 | Griego et al. | 273/384 |

*Primary Examiner*—William H. Grieb

*Attorney, Agent, or Firm*—William E. Noonan

[57] ABSTRACT

A dunk tank seat release mechanism is disclosed including a support that is disposable proximate the rear of a dunk tank. A seat is hingably attached to the support and is alternatable between generally horizontal and collapsed positions. A releasable gripping mechanism holds the seat in a generally horizontal position and includes a pair of opposing, pivotably interconnected stationary and movable jaws. A stationary handle is fixed to a stationary jaw and a movable handle is pivotably attached to the movable jaw. The jaws are biased closed when the movable handle is closed relative to the stationary handle to hold the seat. An actuator member extends between the stationary and movable handles generally laterally of the tank. The actuator member has a thickness between the handles such that a spacing of at least ⅜" is provided between the actuator member and the movable handle. A target is mounted to the actuator member to face generally forward of the tank. The actuator member is pivotably mounted to the support means so that engagement of the target with the predetermined force pivots the actuator member to engage and open the movable handle of the gripping mechanism. As a result, the jaws open and the seat is released.

10 Claims, 3 Drawing Sheets

DUNK TANK SEAT RELEASE MECHANISM

FIELD OF THE INVENTION

This invention relates to a seat release mechanism and in particular, to a release mechanism suitable for use with dunk tanks.

BACKGROUND OF THE INVENTION

Dunk tanks are very popular attractions at amusement parks, fairs and carnivals. An important feature of the dunk tank is the seat release mechanism. This mechanism should hold the seat upright to securely support a person above the dunk tank until a predetermined force, typically from a thrown ball, is applied to a target connected to the mechanism. If the ball strikes the target squarely, the seat release mechanism should operate so that the seat collapses and the supported person falls by his or her own weight into the tank.

Conventional release mechanisms tend to operate unreliably and inconsistently. Often the seat does not release, even when the target is squarely struck. Conversely, certain release mechanisms employ a hair trigger release which may operate prematurely so that the seat drops even when no, or very little force is applied to the target.

SUMMARY OF THE INVENTION

It is therefore an object of this invention to provide an improved dunk tank seat release mechanism which consistently and reliably allows the dunk tank seat to collapse when a predetermined force is applied to the dunk tank target.

It is a further object of this invention to provide such a mechanism which is constructed of light weight, yet sturdy materials and which provides dependable operation over repeated uses.

It is a further object of this invention to provide such a mechanism in which the seat gripping force may be adjusted to release the seat upon the application of various predetermined forces against the target.

It is a further object of this invention to provide such a mechanism which may be quickly and conveniently assembled and disassembled for transport to various locations.

This invention relates to a dunk tank seat release mechanism, including support means that are disposable proximate the rear of a dunk tank. There is a seat, hingably attached to the support means, which is alternatable between generally horizontal and collapsed positions. There are means mounted to the support means for releasably gripping the seat to hold the seat in a generally horizontal position. The means for gripping include a pair of opposing, pivotably interconnected, stationary and movable jaws. A stationary handle is fixed to the stationary jaw and a movable handle is pivotably attached to the movable jaw. There are means for biasing the jaws closed when the movable handle is closed relative to the stationary handle to hold the seat. An actuator member extends from between the stationary and movable handles generally laterally of the tank. The actuator member has a thickness between the handles such that a spacing of at least ⅜" is provided between the actuator member and the movable handle. The actuator member further includes means for mounting a target to face generally forward of the tank. There are means for pivotably mounting the actuator to the support means. Engagement of the target with a predetermined force pivots the actuator member to engage and open the movable handle of the gripping means so that the jaws open and the seat is released.

In a preferred embodiment the support means include a generally depending bracket to which the gripping means are secured. The depending bracket may include guide means adjacent to the gripping means for receiving the actuator member and limiting pivoting thereof. The seat may include a generally U-shaped element that is engagable by the jaws of the gripping means when the jaws are closed to hold the seat in the generally horizontal position. The support means may include a frame that extends from proximate the rear of the tank in a direction generally laterally of the tank.

The actuator member may include a generally L-shaped rod having a first leg with a reduced thickness portion proximate one end generally between the handles of the gripping means. A second leg may extend forwardly from the other end of the first leg. The means for mounting the target may be disposed proximate a distal end of the second leg of the rod. The means for mounting may include thread means formed about the rod and complementary thread means connected to the target. The means for pivotably mounting may include a cylindrical sleeve fixed to and extending rearwardly from the support means for slidably receiving the second leg of the rod. Pivot means may interconnect the support means and the first leg of the rod. The pivot means may include a turnbuckle having a first hook that is attached to the support means and a second hook that is attached to the first leg of the actuator member.

DISCLOSURE OF THE PREFERRED EMBODIMENT

Other objects, features and advantages will occur from the following description of preferred embodiments and the accompanying drawings, in which.

Figure 1:
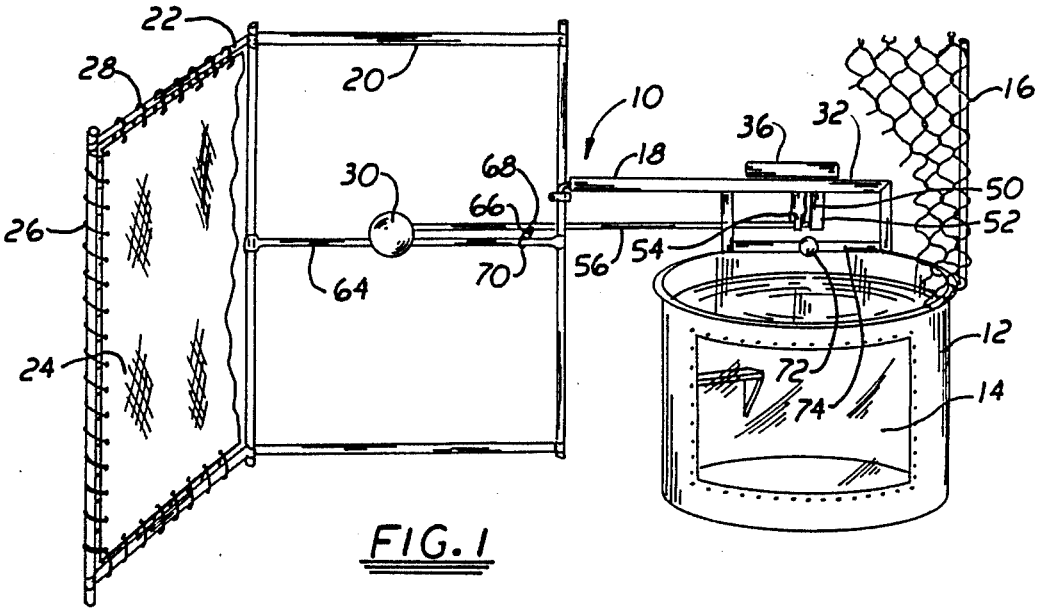
FIG. 1 is an axonometric, partially cut away view of a dunk tank that employs the seat release mechanism of this invention.

There is shown in FIG. 1 a seat release mechanism 10 for use with a conventional dunk tank 12. The dunk tank may have various sizes and includes a front window 14 which permits the audience to watch a person who has been dunked into the tank. A net 16, only a portion of which is shown, is mounted to the front of tank 12 so that balls that are thrown at the dunk tank target do not hit the person sitting above the tank.

Support means, typically comprising a frame 18 are disposed in a conventional manner proximate the rear of tank 12. Frame 18 may be constructed so that the tank 12 can be mounted directly to, or in a recess of frame 18. Frame 18 extends laterally from tank 12 and includes a pair of side frame portions 20 and 22. The frame 18 is typically constructed of light weight, but sturdy material such as tubular steel. More particularly, the side portions 20 and 22 of frame 18 are preferably constructed of 1" E.M.T. galvanized pipe. Side sections 20 and 22 typically form the target area and backstop for the dunk tank. A plastic, canvas or cloth curtain 24 is hung across sections 20 and 22. Curtain 24 is mounted by any acceptable means such as rope 26 or hooks 28 similar to whose used with shower curtains. Curtain 24 is shown extending only across section 22 and has been omitted from section 20 for clarity. An opening is made in curtain 24 so that dunk tank target 30 extends through the curtain. Target 30 is mounted and operates in a manner which will be described below.

Figure 2:
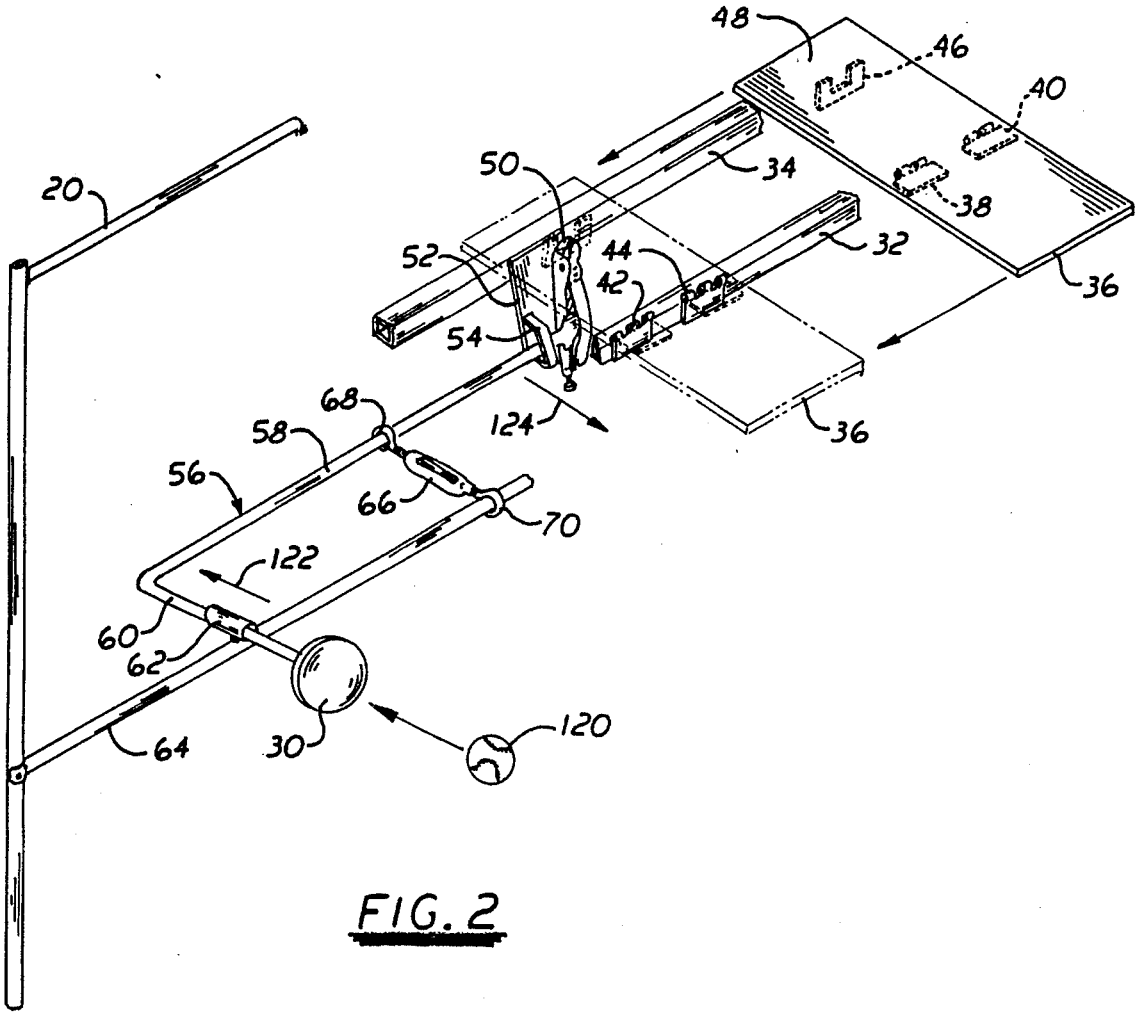
FIG. 2 is an upper perspective, partially exploded view of the seat release mechanism.

As shown in FIGS. 1 and 2, frame 18 includes a pair of relatively thick cross beams 32 and 34 having a square cross sectional shape. Beam 32 extends generally over the tank 12 and beam 34 is positioned behind the tank. Seat 36 is collapsibly mounted on beam 32 by hinge elements 38 and 40 that are secured to the bottom of seat 36. Hinge elements 38 and 40 pivotably engage respective complementary hinge elements 42 and 44 that are welded, bolted or otherwise attached to beam 32. A U-shaped element 46 is dependably attached to the bottom surface of seat 36 proximate the rearward end 48 of the seat. When seat 36 is in a generally horizontal or upright position, as shown in Figs. 1 and 2, the rearward portion 48 of the seat 36 rests on beam 34 and U-bolt 46 depends from the seat slightly in front of beam 34. As a result, the U-bolt may be engaged by a releasable gripping mechanism 50, in the manner described more fully below.

Gripping mechanism 50 is mounted on a bracket 52 which is itself dependably fixed to beam 34. The bracket may be welded, bolted or permanently attached by any other means to beam 34. Gripping mechanism 50 is permanently secured to the bracket, typically by welding. Bracket 52 includes a slotted guide 54 that is permanently mounted on the bracket adjacent to the gripping mechanism.

As further shown in FIGS. 1 and 2, an elongate, L-shaped actuator member 56 extends generally from gripping mechanism 50, through guide 54, laterally of tank 12. Member 56 includes a relatively long first leg 58 and a relatively short second leg 60 that extends generally perpendicularly from leg 58. The actuator is constructed of relatively lightweight, but rigid material such as E.M.T. galvanized pipe that provides for improved operation. Moreover, assembly and transport are facilitated by the use of such material. As best shown in FIG. 2, leg 60 is slidably received through a generally cylindrical sleeve 62 that is secured, such as by welding, on element 64 of frame section 20. Leg 60 then extends forwardly through the curtain, not shown, and the dunk tank target 30 is attached at the outer end of leg 60. Actuator member 56 is pivotably interconnected to element 64 by a turnbuckle 66 that has hooks 68 and 70 which are engaged with leg 58 and frame element 64, respectively.

As shown in FIG. 1, a soft or resilient ball 72 is mounted to frame 18 immediately above tank 12. This ball absorbs the impact of seat 36 as the seat collapses against the bottom beam 74 of frame 18.

Figure 3:
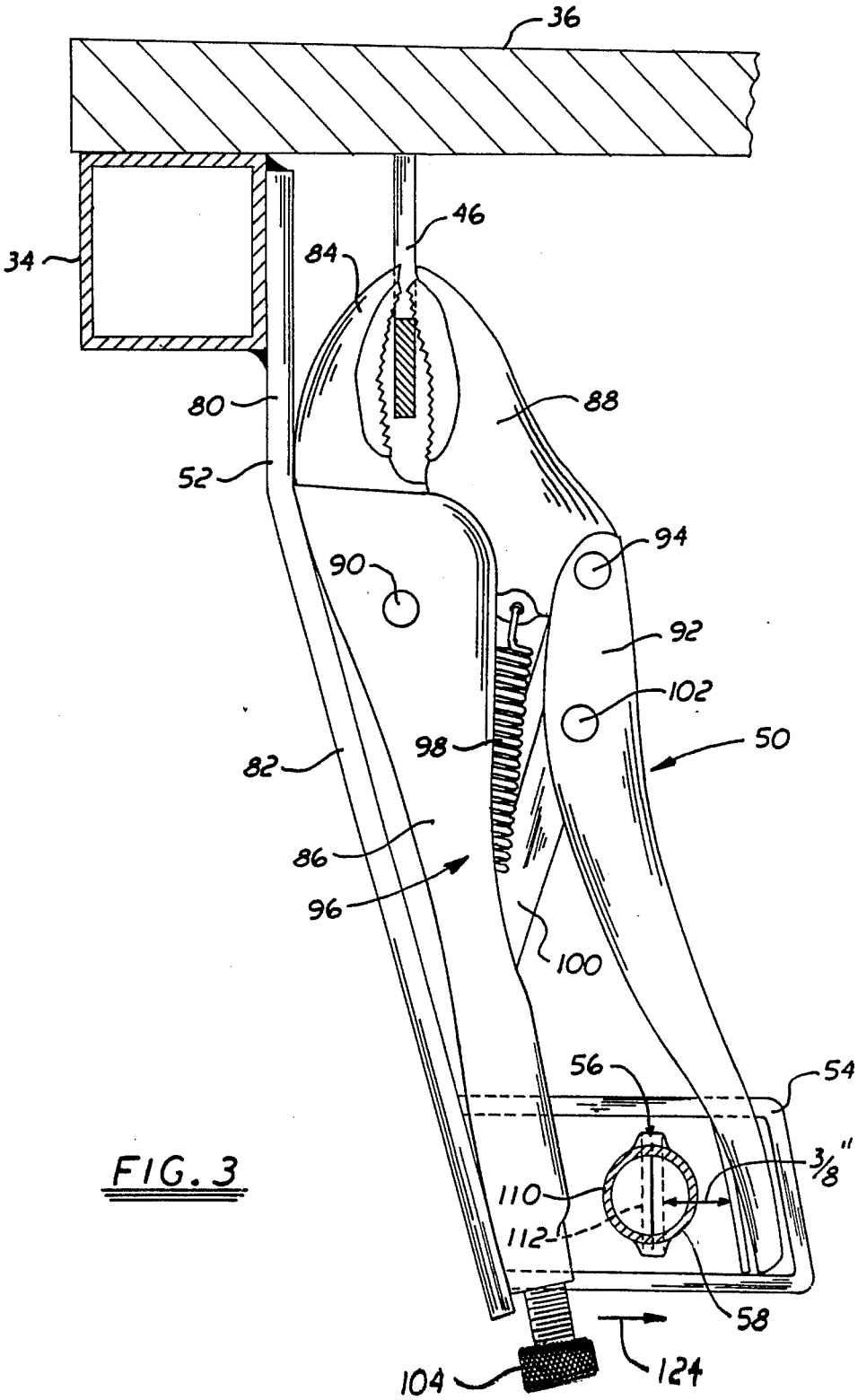
FIG. 3 is a side elevational view of the gripping means and the actuator member which releases the gripping means.

Gripping mechanism 50 is shown and described more fully in FIG. 3. Mounting bracket 52 includes a first portion 80 that is attached to frame beam 34 and a second portion 82 that extends generally at an angle from portion 80. Gripping mechanism 50 includes a stationary jaw 84 and a stationary handle 86 that is fixed to jaw 84. An opposing movable jaw 88 is pivotably attached by pivot 90 to jaw 84. A movable handle 92 is attached by pivot 94 to movable jaw 88. There are means 96 for biasing the jaws closed when handle 92 is closed relative to handle 86. Such means for biasing 96 include a spring 98 that is connected between movable jaw 88 and stationary handle 86, and a lever 100 that has one end connected by a pivot 102 to movable handle 92, and an opposite end, not shown, that engages the upper end of tension adjusting screw 104 in handle 86. In this embodiment gripping mechanism 50 comprises a conventional gripping tool known as the Vice Grip (TM). However, the invention is not limited to the use of such a tool and in alternative embodiments various other tools that use the claimed releasable gripping structure may be employed.

Stationary jaw 84 and stationary handle 86 are permanently fixed, such as by welding, to the broad surface of bracket 52. To hold seat 36 in an upright, generally horizontal position, mechanism 50 is opened by separating handle 92 from handle 86. This separates jaws 84 and 88. Seat 36 is then pivoted about its hinges until U-bolt 46 is received between jaws 84 and 88. Handle 92 is then closed relative to handle 86. This closes jaws 84 and 88, as shown in FIG. 3, so that the jaws engage each other through the opening in the U-bolt. The jaws are biased closed by biasing means 96 and, as a result, U-bolt 46 is engaged and held in place by the jaws. This prevents seat 36 from collapsing, even when a person is seated on the seat over the tank.

As further shown in FIG. 3, guide 54 is adjacent to gripping mechanism 50. Actuator member 56 extends through the opening in guide 54 and between handles 86 and 92 of gripping mechanism 50. Actuator member 56 includes a generally cylindrical rod 110 that forms both first leg 58 and second leg 60. The distal end of leg 58, which extends between handles 86 and 92, is flattened into a reduced thickness portion 112. The reduced thickness portion 112 is spaced at least ⅜" from movable handle 92 in its closed position. As a result, actuator member 56 must move at least ⅜" before engaging handle 92. This spacing prevents gripping mechanism 50 from operating as a hair trigger and prematurely releasing seat 36 when minimal force is exerted on the actuator member.

Figure 4:
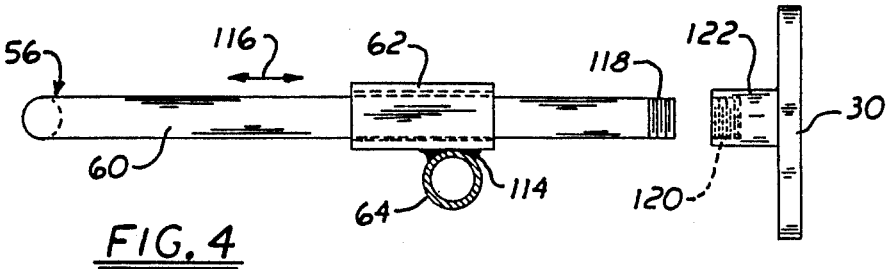
FIG. 4 is a side elevational, sectional view of the distal leg of the actuator member and the target which is attached thereto.

As shown in FIG. 4, second leg 60 of actuator member 56 extends through sleeve 62. The sleeve is mounted, such as by welding 114, on frame element 64. As indicated by double headed arrow 116, there is sufficient clearance through sleeve 62 for leg 60 to slide back and forth through the sleeve. Sleeve 62 is extended rearwardly from frame element 64 so that improved support is provided for leg 60 of actuator member 56.

The distal end of leg 60 includes a threaded portion 118 that engages and holds a complementary threaded portion 120 on the inside circumference of collar 122 of target 30. This enables target 30 to be securely and quickly mounted and attached to the end of leg 60 of actuator member 56.

Figure 5A:
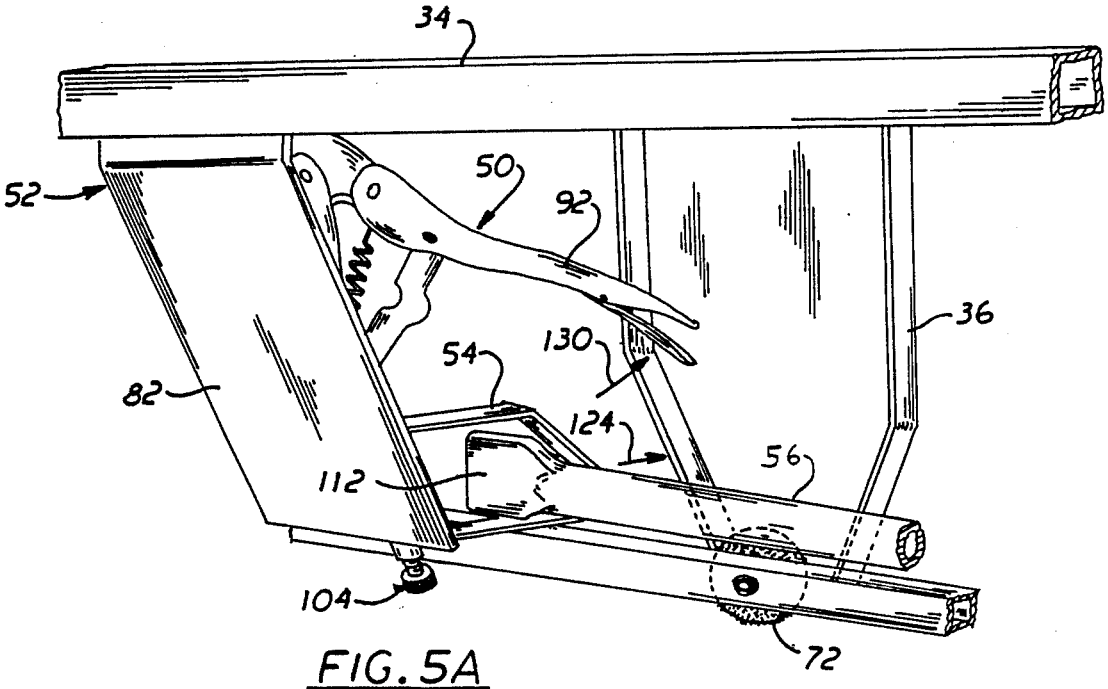
FIG. 5A is an axonometric view of the gripping means after it has been released to collapse the dunk tank seat.
Figure 5B:
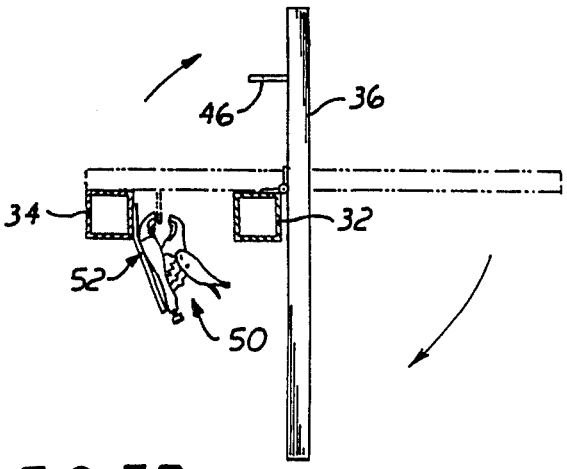
FIG. 5B is an elevational side view of the collapsed seat.

In operation, the seat 36 is pivoted into its upright horizontal position and gripping mechanism 50 is closed to hold the seat in place, as shown in FIGS. 1 through 3. A person then sits on seat 36 while other participants throw tennis balls or similar projectiles at target 30. When a ball 120, FIG. 2, hits target 30 with sufficient force, the target is driven, in the direction of arrow 122, through supporting sleeve 62. Actuator member 56 pivots about turnbuckle 66 so that the reduced thickness portion 112 at the opposite end of the actuator member pivots in the direction of arrow 124, as shown in FIGS. 2 and 5. If portion 112 engages movable handle 92 with a sufficient predetermined force to overcome the biasing means 96 that are keeping the gripping mechanism closed, the handle 92 will snap open in the direction of arrow 130, FIG. 5. This causes movable jaw 88 to open relative to stationary jaw 84 so that U-bolt 46 is released. Seat 36 immediately pivots about its hinges due to the weight of the person seated on seat 36. This causes seat 36 to collapse, as shown in FIGS. 5A and 5B, and the seated person is dropped into tank 12.

Because portion 112 of actuator member 56 has a reduced thickness and at least ⅜" clearance is provided between the actuator member and handle 92, premature release of the gripping mechanism is prevented. Slight movement of the actuator is insufficient to open handle 92; a square hit of the target is required. The spacing between the actuator member and the handle is also increased because of the angle formed by portion 82 of bracket 52.

After actuator member 56 engages handle 92 and triggers the release of gripping mechanism 50, further movement of the actuating rod 56 is not required. Accordingly, guide 54 limits the pivoting of actuator member 56. This prevents the actuator member from striking the frame and/or interfering with the collapsing seat.

The amount of force required to release the seat may be adjusted by tightening or loosening adjustment screw 104 at the base of stationary handle 86. By tightening this screw, the biasing means 96 are tightened in a conventional manner, and a greater force is required to overcome this bias and open the jaws. By loosening screw 104, a softer force striking target 30 is capable of releasing the gripping mechanism.

To reset the mechanism, the seat is simply returned to its upright position and the jaws of the gripping mechanism 50 are closed by closing movable handle 92 relative to stationary handle 86. The seat 36 is again held in place for subsequent use.

Although specific features of the invention are shown in some drawings and not in other, this is for convenience only as each feature may be combined with any or all of the other features in accordance with the invention. Other embodiments will occur to those skilled in the art and are within the following claims.

I claim:

1. A dunk tank seat release mechanism comprising support means disposable proximate the rear of a dunk tank a seat hingably attached to said support means and being alternatable between generally horizontal and collapsed positions;

means, mounted to said support means, for releasably gripping said seat to hold said seat in a generally horizontal position, said means for gripping including a pair of opposing, pivotably interconnected, stationary and movable jaws, a stationary handle fixed to said stationary jaw, a movable handle pivotably attached to said movable jaw and means, for biasing said jaws closed when said movable handle is closed relative to said stationary handle to hold said seat;

an actuator member extending from between said stationary and movable handles generally laterally of the tank, said actuator member having a thickness between said handles such that a spacing of at least ⅜" is provided between said actuator member and said movable handle, and further including means for mounting a target to face generally forward of the tank; and means for pivotably mounting said actuator member to said support means; whereby engagement of said target with a predetermined force pivots said actuator member to engage and open said movable handle of said gripping means so that said jaws open and said seat is released.

2. The mechanism of claim 1 in which said support means include a generally depending bracket to which said gripping means are secured.

3. The mechanism of claim 2 in which said depending bracket includes guide means adjacent said gripping means for receiving said actuator member and limiting pivoting thereof.

4. The mechanism of claim 1 in which said seat includes a generally U-shaped element that is engagable by said jaws of said gripping means when said jaws are closed to hold said seat in the generally horizontal position.

5. The mechanism of claim 1 in which said actuator member includes a generally L-shaped rod having a first leg with a reduced thickness portion proximate one end generally between said handles of said gripping means and a second leg that extends forwardly from the other end of said first leg, said means for mounting a target being disposed proximate a distal end of said second leg of said rod.

6. The mechanism of claim 5 in which said means for mounting include thread means formed about said rod and complementary thread means connected to said target.

7. The mechanism of claim 5 in which said means for pivotably mounting include a cylindrical sleeve fixed to and extending rearwardly from said support means for slidably receiving said second leg of said rod, and pivot means for interconnecting said support means and said first leg of said rod.

8. The mechanism of claim 7 in which said pivot means include a turnbuckle having a first hook that is attached to said support means and a second hook that is attached to said first leg.

9. The apparatus of claim 1 in which said support means include a frame that extends from proximate the rear of the tank in a direction generally laterally of the tank.

10. The apparatus of claim 1 in which the actuator includes a relatively lightweight, but rigid material.

* * * * *